US010141688B2

(12) United States Patent
Wimmer et al.

(10) Patent No.: US 10,141,688 B2
(45) Date of Patent: Nov. 27, 2018

(54) PLUG CONNECTOR WITH RESILIENT ENGAGEMENT ELEMENT AND SEAL

(71) Applicants: Rosenberger Hochfrequenztechnik GmbH & Co. KG, Fridolfing (DE); Huber+Suhner AG, Herisau (CH); Radiall S.A., Aubervilliers (FR)

(72) Inventors: Martin Wimmer, Palling (DE); Florian Fraunhofer, Traunstein (DE); Josef Krautenbacher, Fridolfing (DE); Franz Manser, Herisau (CH); Claude Brocheton, Coublevie (FR)

(73) Assignees: Rosenberger Hochfrequenztechnik GmbH & CO. KG, Fridolfing (DE); Huber+Suhner AG, Herisau (CH); Radiall S.A., Aubervilliers (FR)

( * ) Notice: Subject to any disclaimer, the term of this patent is extended or adjusted under 35 U.S.C. 154(b) by 0 days.

(21) Appl. No.: 15/743,717

(22) PCT Filed: Apr. 6, 2017

(86) PCT No.: PCT/EP2017/000432
§ 371 (c)(1),
(2) Date: Jan. 11, 2018

(87) PCT Pub. No.: WO2017/178101
PCT Pub. Date: Oct. 19, 2017

(65) Prior Publication Data

US 2018/0205175 A1 Jul. 19, 2018

(30) Foreign Application Priority Data

Apr. 15, 2016 (DE) ..... 10 2016 004 708
May 30, 2016 (DE) ..... 10 2016 006 597

(51) Int. Cl.
*H01R 13/52* (2006.01)
*H01R 13/627* (2006.01)
(Continued)

(52) U.S. Cl.
CPC ..... *H01R 13/6275* (2013.01); *H01R 13/5219* (2013.01); *H01R 13/6273* (2013.01); *H01R 24/40* (2013.01); *H01R 2103/00* (2013.01)

(58) Field of Classification Search
CPC ..... H01R 13/5219; H01R 13/6271; H01R 13/6272; H01R 13/6273; H01R 13/6275; H01R 24/42; H01R 24/40
(Continued)

(56) References Cited

U.S. PATENT DOCUMENTS 6,709,289 B2 * 3/2004 Huber ..... H01R 13/6277 439/352
7,351,088 B1 * 4/2008 Qu ..... H01R 13/5219 439/352
(Continued)

FOREIGN PATENT DOCUMENTS

DE 2353004 B2 5/1974
DE 60223464 T2 2/2003
(Continued)

OTHER PUBLICATIONS

English translation of incoming written opinion (PCT/EP2017/000432) dated Jun. 4, 2017.*

*Primary Examiner* — Chandrika Prasad
(74) *Attorney, Agent, or Firm* — David P. Dickerson

(57) ABSTRACT

The invention relates to a connector comprising a first connector portion and a second connector portion, the first connector portion comprising a seal, a resilient detent element and an outer conductor portion, a portion of the resilient detent element contacting a radially outward facing
(Continued)

surface of the outer conductor portion, the second connector portion comprising a counterpart detent element, in a mated configuration of the first connector portion and the second connector portion, the resilient detent element engages the counterpart detent element and locks the first connector portion to the second connector portion, and a compression of the seal in the mated configuration effecting a force parallel to a longitudinal axis of the first connector portion, the force inhibiting play between the resilient detent element and the counterpart detent element.

14 Claims, 7 Drawing Sheets

(51) Int. Cl.
*H01R 24/40* (2011.01)
*H01R 103/00* (2006.01)

(58) Field of Classification Search
USPC ..... 439/271, 350, 352, 357
See application file for complete search history.

(56) References Cited

U.S. PATENT DOCUMENTS

| | | | | |
|---|---|---|---|---|
| 9,065,207 | B2 * | 6/2015 | Chapel | H01R 43/26 |
| 2003/0027435 | A1 * | 2/2003 | Schneider | H01R 13/6277 439/63 |
| 2005/0215106 | A1 * | 9/2005 | Holub | H01R 13/506 439/357 |
| 2007/0161288 | A1 * | 7/2007 | Entsfellner | H01R 13/6277 439/578 |
| 2008/0139029 | A1 * | 6/2008 | Tsuji | H01R 13/4364 439/271 |
| 2009/0305560 | A1 * | 12/2009 | Chen | H01R 13/5219 439/584 |

FOREIGN PATENT DOCUMENTS

| | | | |
|---|---|---|---|
| DE | 202004015502 | U1 | 12/2004 |
| EP | 1860744 | A2 | 11/2007 |
| EP | 1906492 | A1 | 4/2008 |
| EP | 2304851 | B1 | 4/2012 |
| EP | 2961004 | A1 | 12/2015 |

* cited by examiner

PLUG CONNECTOR WITH RESILIENT ENGAGEMENT ELEMENT AND SEAL

BACKGROUND OF THE INVENTION

Field of the Invention

The present disclosure relates to a plug connector, in particular a high-frequency plug connector, having a first connector, in particular a coaxial connector, which has a first inner conductor part, a first outer conductor part and a first insulating part for holding the first inner conductor part radially within and coaxially with respect to the first outer conductor part, and having a second connector, in particular coaxial connector, which is designed for being axially plugged into the first connector in a joining direction and which has a second inner conductor part, a second outer conductor part and a second insulating part for holding the second inner conductor part radially within and coaxially with respect to the second outer conductor part, wherein, in a plugged-together state of first and second connector, the first inner conductor part electrically and mechanically contacts the second inner conductor part and the first outer conductor part electrically and mechanically contacts the second outer conductor part, wherein the first connector has a first surface and the second connector has a second surface, between which a seal is arranged, and compressed in an axial direction, in the plugged-together state.

Description of the Related Art

A plug connector of said type is known for example from EP 2 304 851 B1, and has a screw-type interconnection which is cumbersome in terms of handling.

For the fixing of the first connector to the second connector, it is for example possible for spring contact elements to be provided which form a detent interconnection which is simpler in terms of handling. However, for the interconnection of the first connector to the second connector, a minimum amount of axial play is required in a joining direction or in a main direction of extent or along a longitudinal axis of the plug connector. Said axial play permits undesired displacements of the two connectors relative to one another, which impairs the electrical contact quality.

BRIEF SUMMARY OF THE INVENTION

It is an aim of the present invention to improve the electrical contact quality in the case of plug connectors with a detent interconnection, albeit without encumbering handling, in light of this background, the present disclosure teaches a plug connector as recited in independent claim 1. Various embodiments are recited in dependent claims.

Regarding a plug connector of the aforementioned type, the present disclosure further teaches that the first connector has at least one detent element and the second connector has at least one counterpart detent element, such that, as the first connector is axially plugged into the second connector, in a plugged-together state, the at least one detent element and the at least one counterpart detent element engage into one another and lock the first connector to the second connector in the plugged-together state, wherein the first connector and the second connector are pushed apart in an axial direction and counter to the joining direction by a restoring force of the compressed seal, such that the detent element is pushed against the point of engagement with the counterpart detent element in a play-free manner.

This has the advantage that, as a result of the elastic compression of the seal, a restoring force is provided without an additional spring component, which restoring force, after the formation of the detent interconnection between the first connector and the second connector, pushes the second connector along the longitudinal axis of the plug connector counter to the joining direction into a defined position. The position of the second connector in relation to the first connector is thus defined in a play-free manner, and a play-induced displacement is no longer possible, such that constant contact quality is ensured.

In one embodiment, the detent element is radially elastically deflectable. An automatic engagement of the detent element and the counterpart detent element as the first connector is plugged into the second connector is thus achieved. The ease of handling is thus increased.

In a further embodiment, the first surface is a section of a groove or shoulder for partially receiving or supporting the seal. The seal may be partially received in the groove such that a first section of the seal is received in the groove and a second section of the seal is outside the groove. A wall of the groove or a wall section then forms the first surface. Alternatively, a shoulder may provide at least one contact or support surface for the seal, which then provides the first surface.

In a further embodiment, the first surface is formed as a planar section of the groove or shoulder and has a normal vector which extends substantially parallel to a longitudinal axis of the plug connector. A normal vector is to be understood to mean a vector which is orthogonal, that is to say at right angles or perpendicular, to a plane or surface. A straight line that said vector has as a directional vector is referred to as normal. "Extending substantially parallel to a longitudinal axis of the plug connector" is to be understood as meaning lying within normal manufacturing tolerances. Owing to the first surface being formed as a planar section, the normal vector of which extends substantially parallel to a longitudinal axis of the plug connector, a high axial force for pressing detent element and counterpart detent element against one another can be provided.

In a further embodiment, the second surface is formed and arranged such that the seal is elastically deformed additionally in a radial direction, preferably in a radially inward direction. In this way, the seal is secured against being squeezed out of a region between the first and second surfaces.

In a further embodiment, the second surface has a bevel for the elastic deformation of the seal. A bevel is to be understood here to mean a chamfered surface at a component edge. In general, a bevel has an angle of 45° with respect to the plane. Angles of 60° are however also common. Bevels are generally continuous formations on a continuous component edge. Thus, a deformation of the seal in an axial and/or in a radial direction can be achieved with only one single second surface.

In a further embodiment, the second surface is arranged on a face-side end and/or on an inner surface of the second connector. A structurally simple and functionally reliable construction of the plug connector can thus be achieved. Here, the counterpart detent element may be arranged on an outer surface of the second outer conductor. The second surface and the counterpart detent element are optionally arranged oppositely on the second outer conductor.

In a further embodiment, the second surface is arranged on an inner surface of the second outer conductor. Thus, the second outer conductor has a dual function, that is to say it forms a section of an electrical interconnection and provides the second surface. Thus, a plug connector can be provided which has a particularly simple construction.

In a further embodiment, the counterpart detent element is arranged on an outer surface of the second outer conductor. Thus, the outer conductor has a third function, specifically additionally the provision of counterpart detent elements. The construction of the plug connector can thus be simplified yet further.

The invention also includes a first connector and a second connector for a plug connector of said type.

BRIEF DESCRIPTION OF THE DRAWINGS

The invention will be discussed in more detail below on the basis of the drawing, in which.

DETAILED DESCRIPTION OF THE INVENTION

Figure 1:
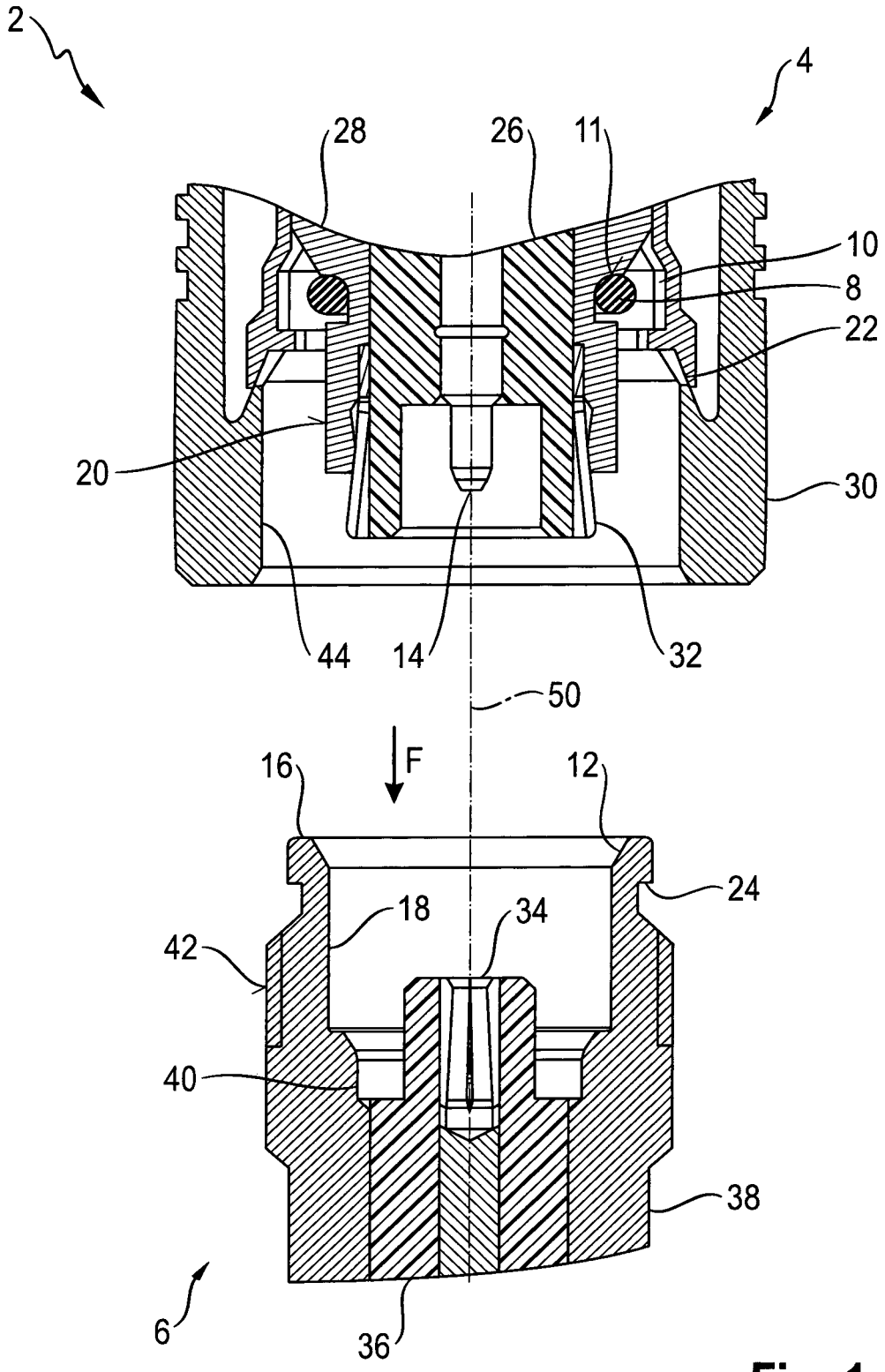
FIG. 1 is a schematic illustration of an exemplary embodiment of a plug connector according to the invention in an exploded illustration.

Reference is made firstly to FIG. 1.

The illustration shows a plug connector 2 having a first connector 4 and a second connector 6.

The plug connector 2 is, in the present exemplary embodiment, a coaxial plug connector and high-frequency plug connector, wherein the first connector 4 can be connected together with the second connector 6 through the formation of a detent interconnection. Such coaxial plug connectors or coaxial detent plug connectors are also referred to as quick-lock connectors or push-pull connectors.

Coaxial plug connectors serve for the releasable interconnection of coaxial cables. Coaxial plug connectors are, like coaxial cables, of coaxial design in order that they have the advantages of the coaxial cable, specifically low electromagnetic interference and radiation and good electrical shielding and an impedance which corresponds to that of the connected coaxial cable in order to avoid reflections at the transition point between coaxial plug connector and coaxial cable. A coaxial cable, also referred to for short as coax cable, is to be understood here to mean a bipolar cable with a concentric construction which has an inner conductor (also referred to as core) which is surrounded, with a constant spacing, by a hollow cylindrical outer conductor. The outer conductor shields the inner conductor from electromagnetic interference radiation. An insulator or dielectric is arranged in the intermediate space between the inner conductor and the outer conductor.

In the present exemplary embodiment, the first connector 4 is formed as a plug, whereas the second connector 6 is formed as a socket. Furthermore, in the present exemplary embodiment, the first connector 4 and the second connector 6 are each formed as coaxial connectors, for example as a coaxial plug and as a coaxial socket.

The first connector 4 has a first inner conductor part 14, which in the present exemplary embodiment is formed by an inner conductor contact pin which is surrounded by a first insulating part 26. In the present exemplary embodiment, the first insulating part 26 has a substantially cylindrical basic shape, in particular hollow cylindrical basic shape, and is inserted into a first outer conductor part 28 which, in the present exemplary embodiment, likewise has a substantially cylindrical basic shape, in particular hollow cylindrical basic shape, and is inserted into an axially displaceable sleeve 30 which, in the present exemplary embodiment, has a substantially cylindrical basic shape, in particular hollow cylindrical basic shape.

The first outer conductor part 28 may be manufactured from an electrically conductive material and thus form a section of an outer conductor of the plug connector 2. It is thus, in the present exemplary embodiment, formed as a plug guide body. The sleeve 30 may form an outer housing of the first connector 4 and simultaneously have the function of an unlocking element, by means of which the detent interconnection between the first connector 4 and the second connector 6 can be released. In the present exemplary embodiment, the first outer conductor part 28 likewise has a substantially cylindrical basic shape, in particular hollow cylindrical basic shape, and, in the present exemplary embodiment, a groove or shoulder 10. In the present exemplary embodiment, the groove or shoulder 10 provides a planar section which forms a first surface 11 which, as will be discussed further below, effects a compression of a seal 8 which is partially inserted into, or is supported in, the groove or shoulder 10. The seal 8 may for example be an O-ring. Furthermore, the first outer conductor part 28 has, on its outer side, a detent element 22 for forming a detent interconnection with the second connector 6, as will also be discussed in more detail further below. In the present exemplary embodiment, the detent element 22 is a resilient detent hook for a counterpart detent element 24, formed as a detent surface, on the second connector 6. Furthermore, the first connector 4 has a first outer conductor contact section 32 which, in the present exemplary embodiment, is formed by a plug outer conductor contact which is arranged partially between the first insulating part 26 and the first outer conductor part 28 and which has a free contact surface, for example in the form of contact fingers.

Furthermore, in the present exemplary embodiment, the first connector 4 has a first guide surface 20 which interacts with a second guide surface 18 of the second connector 6, as will be described in detail further below. The first guide surface 20 is for example an outer surface. In the present exemplary embodiment, the outer surface is a cylindrical shell outer surface. Furthermore, the first guide surface 20 is arranged spaced apart from the first outer conductor contact section 32 in an axial direction with respect to a longitudinal axis 50 of the plug connector 2. In the present exemplary embodiment, the first guide surface 20 is formed on an outer surface of the first outer conductor part 28. Furthermore, the first guide surface 20 and the first outer conductor contact section 32 are formed as radially outwardly oriented surfaces.

In the present exemplary embodiment, the first connector 4 has a third guide surface 44 for interacting with a fourth guide surface 42 of the second connector 6, as will likewise be discussed in more detail further below. The third guide surface 44 is formed by an inner surface of the sleeve 30 on the first connector 4. Furthermore, in the present exemplary embodiment, the third guide surface 44 is a cylindrical shell inner surface.

The second connector 6 has a second inner conductor part 34 which corresponds to the first inner conductor part 14 and which, in the present exemplary embodiment, is formed as an inner conductor contact socket and has a substantially cylindrical basic shape, in particular hollow cylindrical basic shape, and is surrounded by a second insulating part 36. The second insulating part 36 likewise has, in the present exemplary embodiment, a substantially cylindrical basic shape, in particular hollow cylindrical basic shape, and is inserted into a main body which in the present exemplary embodiment is of substantially cylindrical form, in particular hollow cylindrical form, for example a second outer conductor part 38. The second outer conductor part 38 may be manufactured from an electrically conductive material and thus form a section of the outer conductor of the plug connector 2.

Furthermore, the second connector 6 has the second guide surface 18 and a second outer conductor contact section 40 which, in the present exemplary embodiment, is formed by a socket outer conductor contact and has a free contact surface. In the present exemplary embodiment, the second guide surface 18 and the second outer conductor contact section 40 of the second connector 6 are spaced apart from one another in an axial direction with respect to the longitudinal axis 50 of the plug connector 2.

Furthermore, the second guide surface 18 is formed on an inner surface of the second outer conductor part 38 and, in the present exemplary embodiment, the second guide surface 18 is a cylindrical-shell-shaped surface of the second outer conductor part 38.

The fourth guide surface 42 is formed by an outer surface on the second outer conductor part 38.

The second outer conductor part 38 has, on a face-side end 16, a second surface 12 which is formed as a 45° bevel in the present exemplary embodiment. Thus, in the present exemplary embodiment, the second surface 12 is formed and arranged such that, as a result of interaction with the first surface 11, the seal 8 elastically deforms axially in the direction of the longitudinal axis 50 of the plug connector 2 and radially inwardly, or in an inward direction. In the present exemplary embodiment, the second surface 12 is arranged on an inner surface of the second outer conductor part 38.

Furthermore, in the present exemplary embodiment, the second outer conductor part 38 has, on the face-side end 16, a counterpart detent element 24 which is arranged opposite the second surface 12. In the present exemplary embodiment, the counterpart detent element 24 is arranged on an outer surface of the second outer conductor part 38.

Not shown in the illustration is a securing sleeve or sleeve nut with thread, for example with an M10×0.75 thread, for the additional securing of the plug connector 2.

Figure 1C:
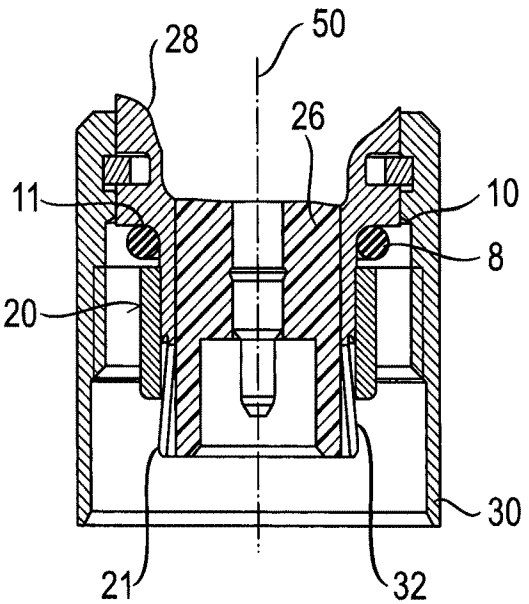
FIG. 1*c* is a schematic illustration of a third exemplary embodiment of a first connector of the plug connector illustrated in FIG. 1.
Figure 1A:
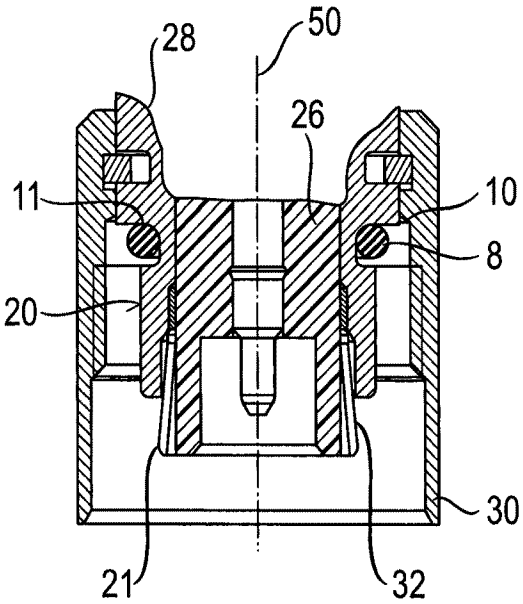
FIG. 1*a* is a schematic illustration of a first exemplary embodiment of a first connector of the plug connector illustrated in FIG. 1.
Figure 1B:
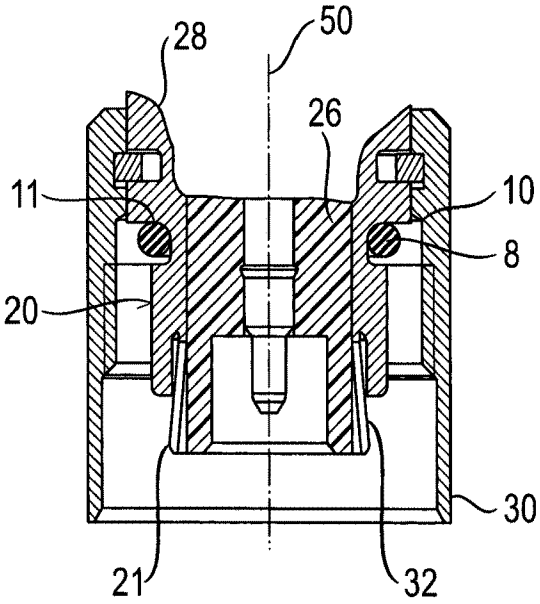
FIG. 1*b* is a schematic illustration of a second exemplary embodiment of a first connector of the plug connector illustrated in FIG. 1.

Reference will now additionally also be made to FIGS. 1*a* to 1*c*.

It is illustrated in FIG. 1*a* that the first outer conductor contact section 32 is formed by a separate component. In the present exemplary embodiment, the separate component is a sleeve 21 which is formed as a spring cage with resilient contact tongues.

By contrast, it is illustrated in FIG. 1*b* that the first outer conductor part 28 together with the sleeve 21, which has the spring cage with resilient contact tongues, of the first outer conductor contact section 32 are formed in one piece and a materially integral manner.

It is illustrated in FIG. 1*c* that the sleeve 21 is at least partially surrounded by the first guide surface 20 which is formed as a separate element. The first guide surface 20 is pressed onto the first outer conductor part 28 and the sleeve 21.

Reference will now additionally also be made to FIGS. 2 to 6.

Figure 2:
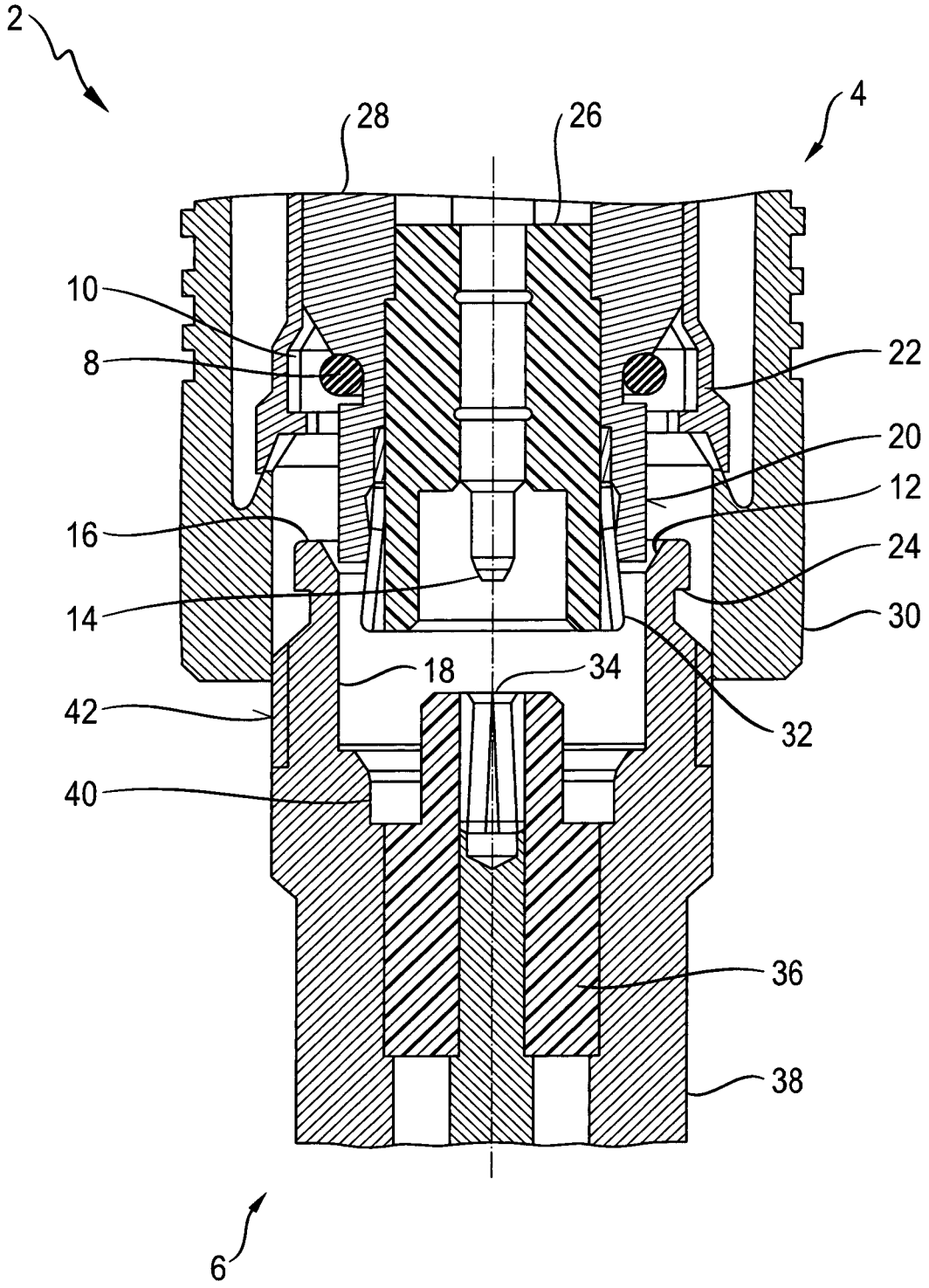
FIG. 2 is a schematic illustration of a first step for the interconnection of the first connector to the second connector.

FIG. 2 shows a first step of the assembly of the plug connector 2, in which the first connector 4 is moved toward the second connector 6 in a joining direction F (see FIG. 1), by means of an axial plugging-in movement along the longitudinal axis 50 of the plug connector 2, until said first connector and second connector come into contact.

The second outer conductor part 38 enters the sleeve 30. It can be seen that the second guide surface 18 of the second outer conductor part 38 comes into contact with the first guide surface 20 of the first outer conductor part 28. Furthermore, in the present exemplary embodiment, the fourth guide surface 42 of the second outer conductor part 38 simultaneously comes into contact with the third guide surface 44 of the sleeve 30. Alternatively, the fourth guide surface 42 of the second outer conductor part 38 and the third guide surface 44 of the sleeve 30 may precede or follow the second guide surface 18 of the second outer conductor part 38 and the first guide surface 20 of the first outer conductor part 28.

The first guide surface 20 of the first outer conductor part 28 forms, together with the second guide surface 18, in the present exemplary embodiment the inner surface of the second outer conductor part 38, a first guide for guiding the second connector 6 as the first connector 4 is being joined together further with the second connector 6. Owing to the respective cylindrical-shell-shaped form, the first guide forms a first cylindrical guide.

Furthermore, the third guide surface 44 of the sleeve 30 forms, together with the fourth guide surface 42, in the present exemplary embodiment an outer surface of the second outer conductor part 38, a second guide for guiding the second connector 6 as the first connector 4 is being joined together further with the second connector 6. Owing to the respective cylindrical-shell-shaped form, the second guide forms a second cylindrical guide.

Figure 3:
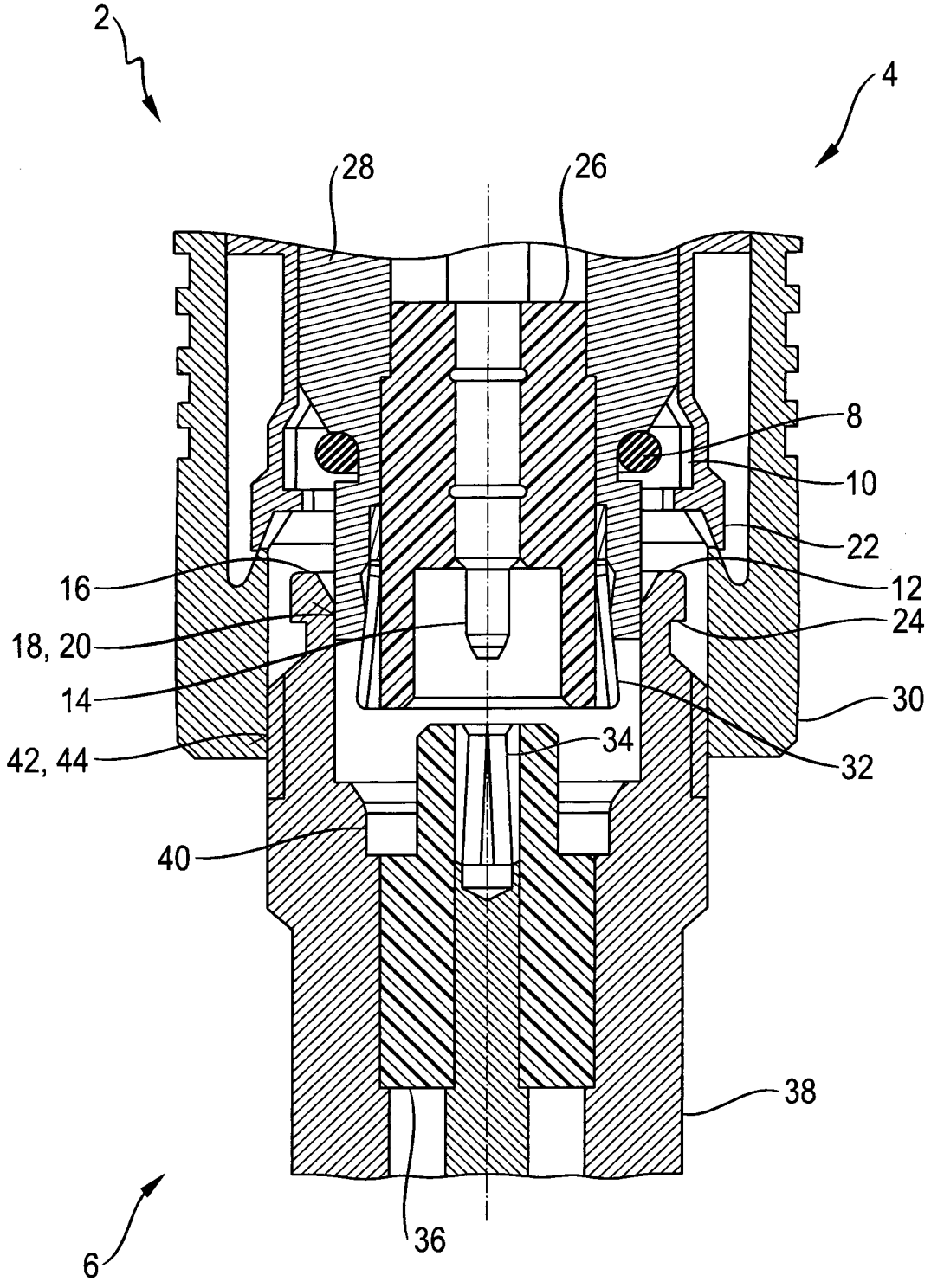
FIG. 3 is a schematic illustration of the continuation of the joining process illustrated in FIG. 1.

FIG. 3 illustrates a continuation of the joining movement.

Figure 4:
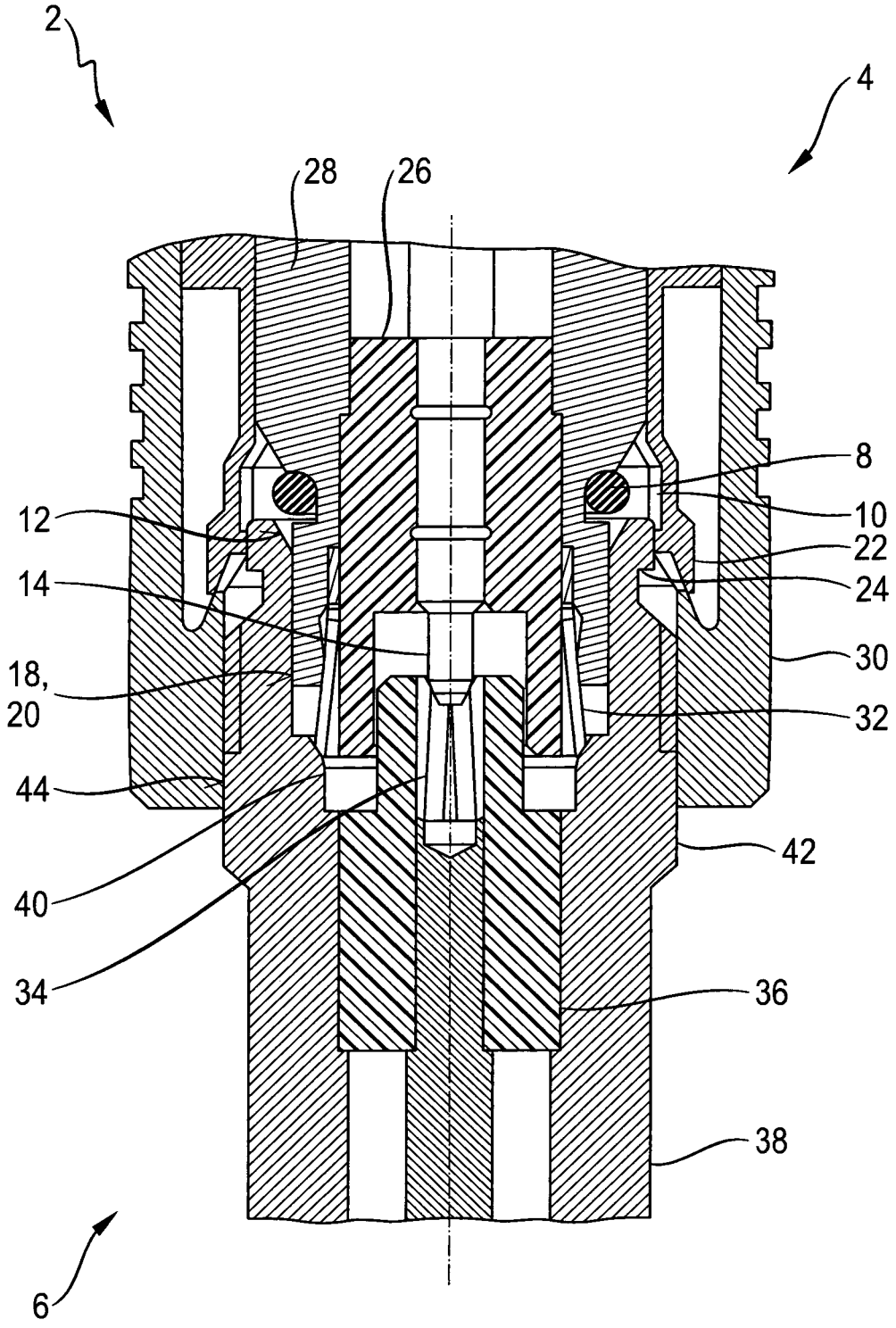
FIG. 4 is a schematic illustration of a second step for the interconnection of the first connector to the second connector.

FIG. 4 illustrates a second step. Now, the first inner conductor part 14 enters the second inner conductor part 34 and thus forms an inner conductor. Furthermore, the free contact surface of the first outer conductor contact section 32 of the first outer conductor part 28 comes into electrical and mechanical contact with the second outer conductor contact section 40 of the second outer conductor part 38, and thus forms an outer conductor.

Figure 5:
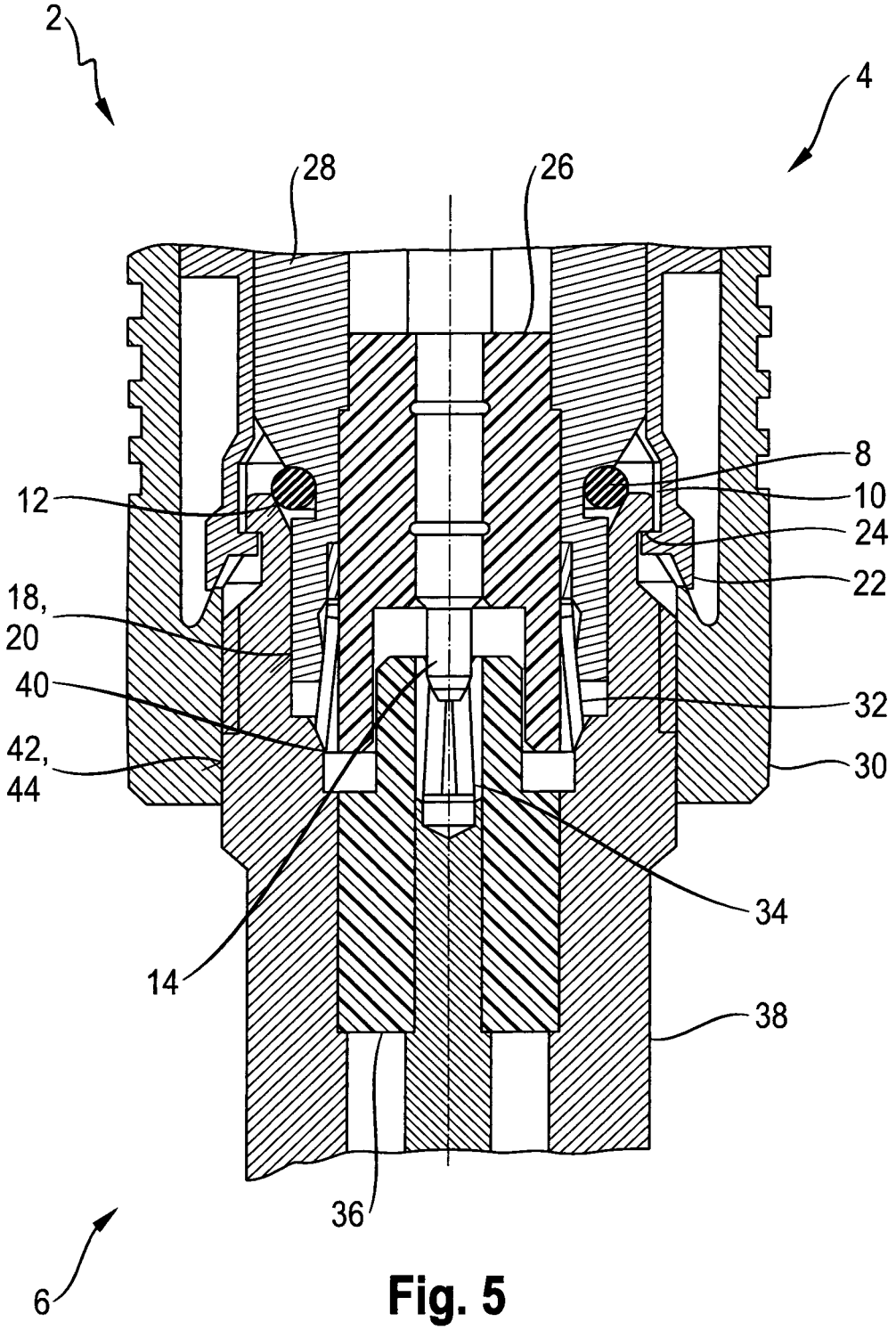
FIG. 5 is a schematic illustration of a third step for the interconnection of the first connector to the second connector.

It is thus the case that the second guide surface 18 and the first guide surface 20 of the first guide and also the third guide surface 44 and the fourth guide surface 42 of the second guide come into mechanical contact before the electrical contacts, specifically the first inner conductor part 14 and the second inner conductor part 34 and also the first outer conductor contact section 32 and the second outer conductor contact section 40. In other words, the guides of the plug connector 2 precede its electrical contacts. FIG. 5 illustrates a third step. After the second surface 12 has reached the seal 8 which is supported on the first surface 11, the detent element 22 is also elastically deflected in a radial direction.

As a result, by continuation of the joining movement in an axial direction along the longitudinal axis 50 (joining direction F, see FIG. 1), the seal 8 is compressed until the detent element 22 passes in a radial direction out of engagement with the counterpart detent element 24 and can snap back again in the radial direction.

Furthermore, as a result of the form of the second surface 12 as a bevel, the seal 8 is compressed radially inward. Thus, the seal 8 is secured in its position, and the friction between the second surface 12 and the seal 8, on the one hand, and the friction between the first surface 11 and the seal 8, on the other hand, prevent twisting of the second connector 6 as a result of a rotation about the longitudinal axis 50.

Figure 6:
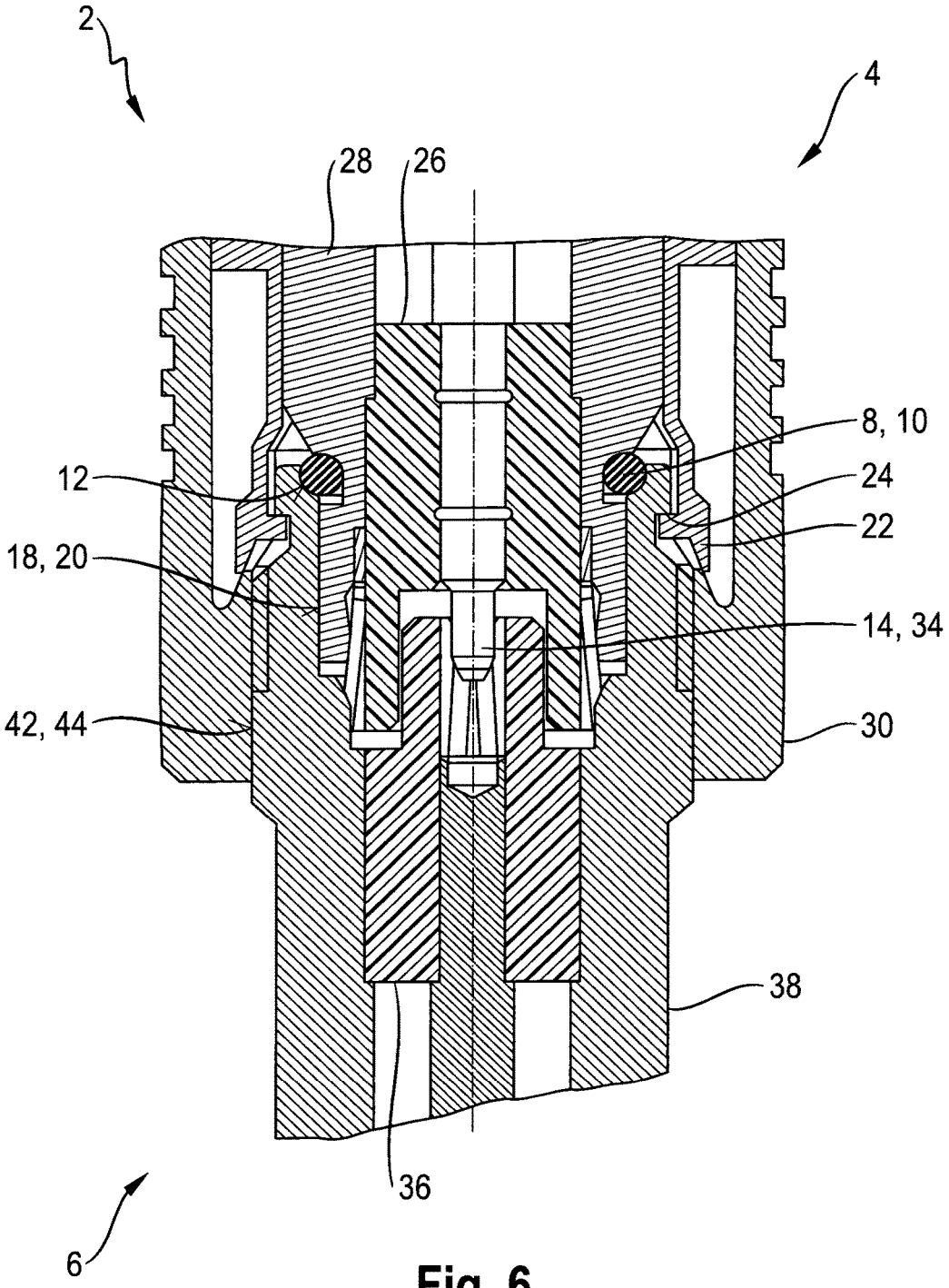
FIG. 6 shows the plug connector illustrated in FIG. 1 in the assembled state.

FIG. 6 illustrates the fully assembled plug connector 2. After the end of the joining movement and the withdrawal of the joining force, the seal 8 expands slightly and pushes the second connector 6 in a direction opposite to the direction of the joining movement F (see FIG. 1), for example by 0.05 mm to 0.4 mm. The compressed seal 8 provides a restoring force which pushes the first connector 4 and the second connector 6 apart. Thus, the detent element 22 and the counterpart detent element 24 come into contact in an axial direction and are secured by the contact pressure which acts in an axial direction owing to the compression of the seal 8. Furthermore, in this way, play is eliminated, that is to say the interconnection is free from play in an axial direction.

Thus, by means of the interaction of the first surface 11 with the second surface 12, which compress the seal 8 both in an axial and in a radial direction, the position of the first connector 4 relative to the second connector 6 is defined, and the electrical contact quality is thus increased without the use of additional components.

The invention claimed is:

1. A connector comprising:

a first connector portion; and a second connector portion, said first connector portion comprising a seal, a resilient detent element, a first inner conductor portion, a first outer conductor portion and a first insulating portion, said first insulating portion supporting said first inner conductor portion radially inward of and coaxially to said first outer conductor portion, a portion of said resilient detent element contacting a radially outward facing surface of said first outer conductor portion, said second connector portion comprising a counterpart detent element, a second inner conductor portion, a second outer conductor portion and a second insulating portion, said second insulating portion supporting said second inner conductor portion radially inward of and coaxially to said second outer conductor portion, in a mated configuration of said first connector portion and said second connector portion, said first inner conductor portion electrically and mechanically contacts said second inner conductor portion, and said first outer conductor portion electrically and mechanically contacts said second outer conductor portion, in said mated configuration said resilient detent element engages said counterpart detent element and locks said first connector portion to said second connector portion, and a compression of said seal in said mated configuration effecting a force parallel to a longitudinal axis of said first connector portion, said force inhibiting play between said resilient detent element and said counterpart detent element.

2. The connector of claim 1, wherein:

at least a portion of said seal is situated in a groove formed in a radially outward facing surface of said first outer conductor portion.

3. The connector of claim 1, wherein:

said seal is situated radially inward of a portion of said resilient detent element.

4. The connector of claim 1, wherein:

said first connector portion comprises a sleeve radially outward of said first outer conductor portion, and a displacement of said sleeve relative to said resilient detent element in a direction parallel to said longitudinal axis and away from an end of said first connector portion that engages said second connector portion effects a disengagement of said resilient detent element from said counterpart detent element.

5. The connector of claim 1, wherein:

said counterpart detent element is formed in a radially outward facing surface of said second connector portion.

6. The connector of claim 1, wherein:

in said mated configuration said second connector portion exerts a force on said seal in a radially inward direction.

7. The connector of claim 1, wherein:

in said mated configuration said seal is compressed against a radially outward facing surface of said first outer conductor portion.

8. The connector of claim 1, wherein:

said first inner conductor portion comprises a protruding portion that protrudes from a surface of said first insulating portion in a first direction, and said first insulating portion extends further in said first direction than said protruding portion.

9. The connector of claim 8, wherein:

said resilient detent element comprises a proximal portion that contacts said first outer conductor portion and a distal portion that extends from said proximal portion in said first direction.

10. The connector of claim 9, wherein:

in a partially mated configuration of said first connector portion and said second connector portion, said distal portion resiliently deflects in a radially outward direction.

11. The connector of claim 1, wherein:

in said mated configuration a portion of said first outer conductor portion is situated radially inward of a portion of said second outer conductor portion.

12. The connector of claim 1, wherein:

in a partially mated configuration of said first connector portion and said second connector portion, said first outer conductor electrically and mechanically contacts said second outer conductor portion, said second insulating portion does not contact said first insulating portion, and second inner conductor does not contact said first inner conductor portion.

13. The connector of claim 1, wherein:

at least one of said first outer conductor portion and said second outer conductor portion comprises a beveled surface that contacts said seal in said mated configuration.

14. The connector of claim 13, wherein:

in said mated configuration said beveled surface compresses said seal in a radial direction.

* * * * *